US008200112B2

(12) United States Patent
Cao et al.

(10) Patent No.: US 8,200,112 B2
(45) Date of Patent: Jun. 12, 2012

(54) FUSER ASSEMBLY HEATER SETPOINT CONTROL

(75) Inventors: Jichang Cao, Lexington, KY (US); James Douglas Gilmore, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 729 days.

(21) Appl. No.: 11/948,077

(22) Filed: Nov. 30, 2007

(65) Prior Publication Data

US 2009/0142086 A1 Jun. 4, 2009

(51) Int. Cl.
*G03G 15/20* (2006.01)

(52) U.S. Cl. ..... 399/69

(58) Field of Classification Search ..... 399/69, 399/70

See application file for complete search history.

(56) References Cited

U.S. PATENT DOCUMENTS

| | | | | |
|---|---|---|---|---|
| 5,448,339 | A | 9/1995 | Kokaji et al. | |
| 5,742,865 | A * | 4/1998 | Yajima et al. | 399/43 |
| 5,742,870 | A | 4/1998 | Hwang | |
| 5,790,919 | A | 8/1998 | Lee | |
| 5,862,435 | A * | 1/1999 | Suzumi et al. | 399/68 |
| 6,018,140 | A | 1/2000 | Hirose et al. | |
| 6,134,400 | A | 10/2000 | Higashi et al. | |
| 6,185,388 | B1 | 2/2001 | Yamamoto | |
| 6,185,389 | B1 | 2/2001 | Bartley et al. | |
| 6,188,955 | B1 | 2/2001 | Robinson et al. | |
| 6,304,731 | B1 * | 10/2001 | Able et al. | 399/45 |
| 6,823,150 | B1 | 11/2004 | Cao et al. | |
| 6,907,204 | B2 | 6/2005 | Cho | |
| 6,927,368 | B2 | 8/2005 | Cao et al. | |
| 6,985,677 | B2 * | 1/2006 | Yamagata et al. | 399/18 |
| 7,020,424 | B2 | 3/2006 | Gilmore et al. | |
| 7,167,660 | B2 | 1/2007 | Gilmore | |
| 7,235,761 | B1 | 6/2007 | Maul et al. | |
| 7,254,351 | B2 | 8/2007 | Cao et al. | |
| 7,272,353 | B2 | 9/2007 | Blair et al. | |
| 2003/0235422 | A1 | 12/2003 | Oyaide | |
| 2006/0051117 | A1 * | 3/2006 | Nishida | 399/69 |

* cited by examiner

*Primary Examiner* — David Gray
*Assistant Examiner* — Gregory H Curran

(57) ABSTRACT

A fuser assembly and a method of controlling a temperature in a fuser assembly are provided. The fuser assembly comprises a heat transfer member, a heater to heat the heat transfer member, and a backup member. The heat transfer member and the backup member define a fusing nip. A first temperature setpoint corresponding to a first thermal load for the heat transfer member is defined. A second temperature setpoint corresponding to a second thermal load for the heat transfer member is defined. The heater is maintained at or near the first temperature setpoint during at least a substantial portion of the time when the heat transfer member is operating at the first thermal load. The heater is maintained at or near the second temperature setpoint during at least a substantial portion of the time when the heat transfer member is operating at the second thermal load.

24 Claims, 3 Drawing Sheets

FUSER ASSEMBLY HEATER SETPOINT CONTROL

FIELD OF THE INVENTION

The present invention relates to a fuser assembly and a method of controlling a temperature in a fuser assembly, and more particularly, to defining multiple temperature setpoints corresponding to multiple thermal loads for a heat transfer member forming part of the fuser assembly.

BACKGROUND OF THE INVENTION

In electrophotography, an imaging system forms a latent image by exposing select portions of an electrostatically charged photoconductive surface to laser light. Essentially, the density of the electrostatic charge on the photoconductive surface is altered in areas exposed to a laser beam relative to those areas unexposed to the laser beam. The latent electrostatic image thus created is developed into a visible image by exposing the photoconductive surface to toner, which contains pigment components and thermoplastic components. When so exposed, the toner is attracted to the photoconductive surface in a manner that corresponds to the electrostatic density altered by the laser beam. The toner pattern is subsequently transferred from the photoconductive surface to the surface of a print substrate, such as paper, which has been given an electrostatic charge opposite that of the toner. The substrate then passes through a fuser assembly that applies heat and pressure thereto. The applied heat causes constituents including the thermoplastic components of the toner to flow onto the surface and into the interstices between the fibers of the substrate. The applied pressure produces intimate contact between toner and fibers and promotes settling of the toner constituents into these interstitial spaces. As the toner subsequently cools, it solidifies adhering the image to the substrate.

The fuser assembly typically includes cooperating fusing members that form a nip area capable of delivering heat and pressure to the substrate passing through the nip. Exemplary nip forming members include a fuser roll and a backup roll, a fuser roll and a backup belt and a fuser belt and backup roll. A heat source associated with one or both of the nip forming members raises the temperature of the fusing members at the nip area to a temperature required by a particular fusing application. As the substrate passes through the nip area, the toner is adhered to the substrate by the pressure between the nip forming members at the nip area and the heat resident in the fusing region.

SUMMARY OF THE INVENTION

In accordance with one aspect of the present invention, a method of controlling a temperature in a fuser assembly is provided. The method comprises providing a heat transfer member, a heater to heat the heat transfer member, and a backup member. The heat transfer member and the backup member define a fusing nip. The method further comprises defining a first heater temperature setpoint corresponding to a first thermal load for the heat transfer member; defining a second heater temperature setpoint corresponding to a second thermal load for the heat transfer member; and maintaining the heater at or near the first temperature setpoint during at least a substantial portion of the time when the heat transfer member is operating at the first thermal load and maintaining the heater at or near the second temperature setpoint during at least a substantial portion of the time when the heat transfer member is operating at the second thermal load. The first temperature setpoint may be different from the second temperature setpoint.

The second thermal load for the heat transfer member may occur when the heat transfer member is stationary relative to the backup member.

The first thermal load for the heat transfer member may occur when the heat transfer member is moving relative to the backup member.

The first thermal load may occur when a printer fan is operating at a first speed and the second thermal load may occur when the printer fan speed is operating at a second speed, which is less than the first speed.

The first thermal load may occur when the heat transfer member is operating at a first speed and the second thermal load may occur when the heat transfer member is operating at a second speed, which is less than the first speed.

The first thermal load may occur when substrates are passing through the fusing nip and have a first interpage gap and the second thermal load may occur when substrates are passing through the fusing nip and have a second interpage gap, which is greater than the first interpage gap.

The first thermal load for the heat transfer member may occur during a substrate fusing operation where a substrate passes through the fusing nip.

The heat transfer member may comprise a belt.

The first temperature setpoint may be greater than the second temperature setpoint.

In accordance with another aspect of the present invention, a fuser assembly is provided and may comprise a heat transfer member; a heater to heat the heat transfer member; a backup member adapted to engage the heat transfer member so as to define a fusing nip with the heat transfer member; and a controller coupled to the heater. The controller may maintain the heater at or near a first temperature setpoint during at least a substantial portion of the time when the heat transfer member is operating at a first thermal load and may maintain the heater at or near a second temperature setpoint during at least a substantial portion of the time when the heat transfer member is operating at a second thermal load. The first temperature setpoint may be different from the second temperature setpoint.

DETAILED DESCRIPTION OF THE INVENTION

In the following detailed description of preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
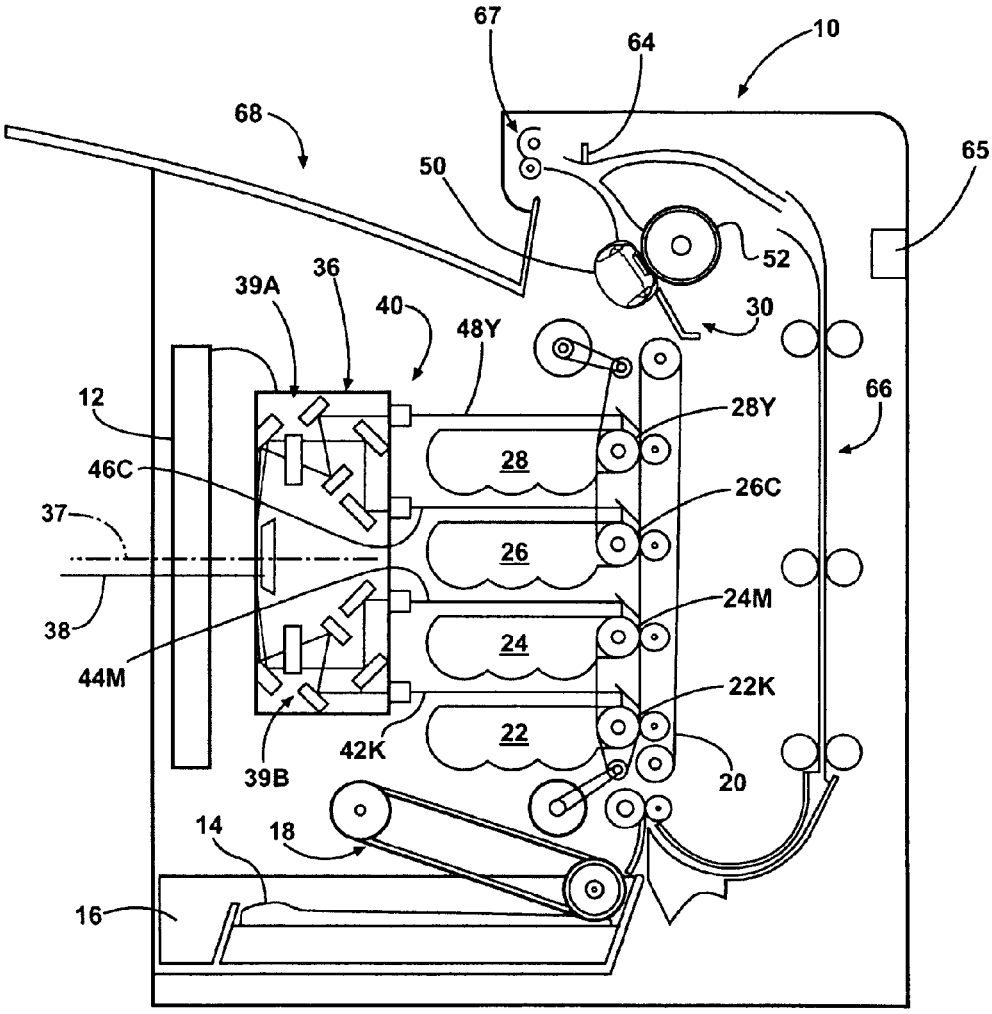
FIG. 1 is a schematic illustration of an electrophotographic printer including a fuser assembly in accordance with an embodiment of the invention.
Figure 2:
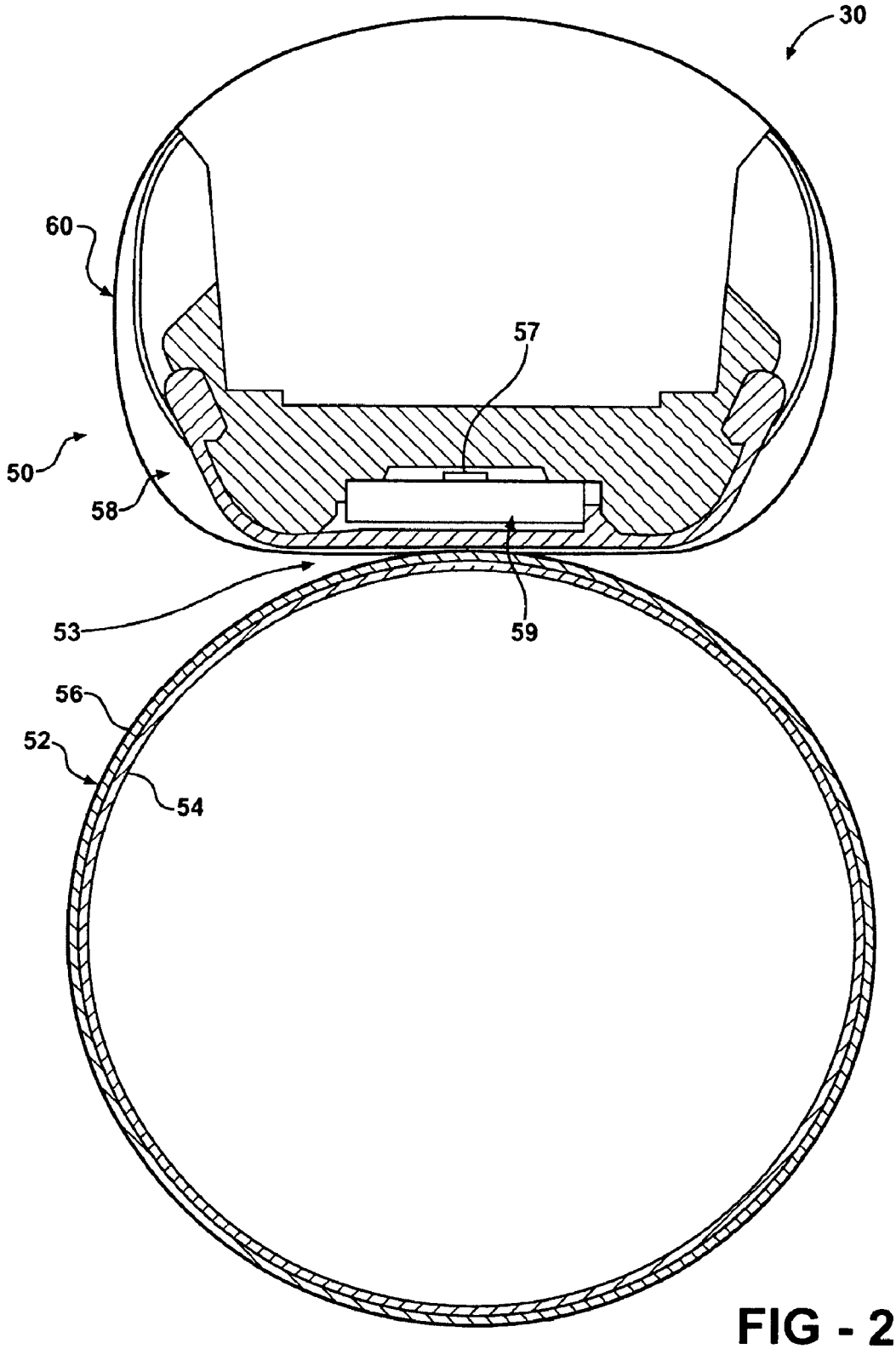
FIG. 2 is a side view, partially in cross section, of the fuser assembly illustrated in FIG. 1.

FIG. 1 depicts an electrophotographic image forming apparatus comprising a color laser printer, which is indicated generally by the numeral 10. An image to be printed is electronically transmitted to a print engine processor or controller 12 by an external device (not shown) or may comprise an image stored in a memory of the controller 12. The controller 12 includes system memory, one or more processors, and other logic necessary to control the functions of electrophotographic imaging.

In performing a print operation, the controller 12 initiates an imaging operation where a top substrate 14 of a stack of media is picked up from a media tray 16 by a pick mechanism 18 and is delivered to a media transport belt 20. The media transport belt 20 carries the substrate 14 passed each of four image forming stations 22, 24, 26, 28, which apply toner to the substrate 14. The image forming station 22 includes a photoconductive drum 22K that delivers black toner to the substrate 14 in a pattern corresponding to a black (K) image plane of the image being printed. The image forming station 24 includes a photoconductive drum 24M that delivers magenta toner to the substrate 14 in a pattern corresponding to the magenta (M) image plane of the image being printed. The image forming station 26 includes a photoconductive drum 26C that delivers cyan toner to the substrate 14 in a pattern corresponding to the cyan (C) image plane of the image being printed. The image forming station 28 includes a photoconductive drum 28Y that delivers yellow toner to the substrate 14 in a pattern corresponding to the yellow (Y) image plane of the image being printed. The controller 12 regulates the speed of the media transport belt 20, media pick timing, and the timing of the image forming stations 22, 24, 26, 28 to effect proper registration and alignment of the different image planes to the substrate 14.

To effect the imaging operation, the controller 12 manipulates and converts data defining each of the KMCY image planes into separate corresponding laser pulse video signals, and the video signals are then communicated to a printhead 36. The printhead 36 may include four laser light sources (not shown) and a single polygonal mirror 38 supported for rotation about a rotational axis 37, and post-scan optical systems 39A, 39B receiving the light beams emitted from the laser light sources. Each laser of the laser light sources emits a respective laser beam 42K, 44M, 46C, 48Y, each of which is reflected off the rotating polygonal mirror 38 and is directed towards a corresponding one of the photoconductive drums 22K, 24M, 26C, 28Y by select lenses and mirrors in the post-scan optical systems 39A, 39B.

The media transport belt 20 then carries the substrate 14 with the unfused toner image planes superposed thereon to a fuser assembly 30. The fuser assembly 30 may comprise a heater assembly 50 defining a heat transfer member and a backup roller 52 defining a pressure member cooperating with the heater assembly 50 to define a fusing nip 53 for conveying substrates 14 therebetween. The heater assembly 50 and the backup roller 52 may be constructed from the same elements and in the same manner as the heater assembly 50 and pressure roller 52 disclosed in U.S. Pat. No. 7,235,761, the entire disclosure of which is incorporated herein by reference.

The heater assembly 50 may comprise a housing structure 58 defining a support member, a heater 59 supported on the housing structure 58, and an endless fuser belt 60 positioned about the housing structure 58. A temperature sensor 57, such as a thermistor, is coupled to a surface of the heater 59 opposite a heater surface in contact with the belt 60. The belt 60 may comprise a thin film, and preferably comprises a stainless steel tube having a thickness of approximately 35-50 microns, an elastomeric layer, such as a silicone rubber layer, having a thickness of approximately 250-350 microns, covering the stainless steel tube and a release layer, such as a PFA (polyperfluoroalkoxy-tetrafluoroethylene) sleeve, having a thickness of approximately 25-40 microns, covering the elastomeric layer. The release layer is formed on the outer surface of the stainless steel tube so as to contact substrates 14 passing between the heater assembly 50 and the backup roller 52.

The backup roller 52 may comprise a hollow core 54 covered with an elastomeric layer 56, such as silicone rubber, and a fluororesin outer layer (not shown), such as may be formed, for example, by a spray coated PFA (polyperfluoroalkoxy-tetrafluoroethylene) layer, PFA-PTFE (polytetrafluoroethylene) blended layer, or a PFA sleeve. The backup roller 52 has an outer diameter of about 30 mm. The backup roller 52 may be driven by a fuser drive train (not shown) to convey substrates 14 through the fuser assembly 30.

An exit sensor 64, see FIG. 1, is provided downstream from the fuser assembly 30 for sensing and generating signals corresponding to the passage of successive substrates 14 through the fuser assembly 30. Based on those signals, the controller 12 can determine an interpage gap between successive substrates 14. For example, the controller 12 may start a count time when a trailing edge of a first substrate is detected by the sensor 64 and stop the count time when a leading edge of a second substrate is detected by the sensor 64. Based on the linear speed of the fuser assembly 30, and the determined count time, the interpage gap between adjacent substrates can be calculated by the controller 12. The interpage gap between successive substrates may also be determined via a substrate input sensor (not shown) located, for example, just downstream from the pick mechanism 18.

The fuser assembly 30 may be cooled by passing air through and across the assembly 30. The air is moved via a cooling fan 65 and travels to the fuser assembly 30 via duct structure (not shown) extending between the cooling fan 65 and the fuser assembly 30. The cooling fan 65 may operate at two or more different speeds. At the higher speed, a greater amount of energy in the form of heat is removed from the fuser assembly 30.

After leaving the fuser assembly 30, a substrate 14 may be fed via exit rollers 67 into a duplexing path 66 for a duplex print operation on a second surface of the substrate 14, or the substrate 14 may be conveyed by the exit rollers 67 into an output tray 68.

For optimum fusing of a substrate of a given type and size, during a fusing operation occurring at a given processing speed and inter-page gap, a temperature of the fuser belt 60 should fall within a corresponding operating temperature range, which, for the color laser printer 10 illustrated in FIG. 1, may comprise a range defined by a corresponding fuser belt temperature $T_B$+/−10 degrees C. The printer 10 illustrated in FIG. 1 does not include a temperature sensor for sensing the temperature of the fuser belt 60. Hence, no fuser belt temperature feedback is provided by a sensor to the controller 12. If the temperature of the fuser belt 60 falls below the range defined by the corresponding fuser belt temperature $T_B$+/−10 degrees C., optimum fusing of a toner image to the substrate may not occur. If the temperature of the fuser belt 60 exceeds the range defined by the corresponding fuser belt temperature $T_B$+/−10 degrees C., toner hot offset may occur.

For each substrate type and size, printer processing speed, and inter-page gap, at least first and second heater temperature setpoints may be predefined and stored in memory. The first and second heater temperature setpoints are defined to correspond respectively to first and second fuser belt thermal loads such that the temperature of the fuser belt 60 remains generally within a corresponding range defined by a corresponding fuser belt temperature $T_B$+/−10 degrees C. while the fuser belt 60 is operating under either the first thermal load or the second thermal load. Hence, the first heater temperature setpoint is defined such that when the heater 59 is controlled to the first heater temperature setpoint or within a corresponding range with the first heater temperature setpoint centered within that range, the temperature of the fuser belt 60 falls within the corresponding range defined by the corresponding fuser belt temperature $T_B$+/−10 degrees C. and wherein the fuser belt 60 is operating under the first thermal load. The second heater temperature setpoint is defined such that when the heater 59 is controlled to the second heater temperature setpoint or within a corresponding range with the second heater temperature setpoint centered within that range, the temperature of the fuser belt 60 falls within the corresponding range defined by the corresponding fuser belt temperature $T_B$+/−10 degrees C. and wherein the fuser belt 60 is operating under the second thermal load. "Thermal load" corresponds to an amount of heat per unit time dissipated by the fuser belt 60. Preferably, the heater 59 provides an equal amount of heat per unit time as that dissipated to maintain the fuser belt temperature at a corresponding fuser belt temperature $T_B$+/−10 degrees C. during operation.

While in the illustrated embodiment, the first and second heater temperature setpoints are defined for each combination of the following factors: substrate type and size, printer processing speed, and interpage gap, it is contemplated that the first and second heater temperature setpoints may alternatively be defined based on one or more of the following factors: substrate type, substrate size, printer processing speed, interpage gap, and/or cooling fan speed. For example, the first and second heater temperature setpoints may be defined for each combination of the following factors: substrate type and size, printer processing speed, interpage gap, and cooling fan speed. It is also contemplated that a first heater temperature setpoint may be defined for a combination of factors comprising a first substrate type and size, a first printer processing speed and a first interpage gap, and a second heater temperature setpoint may be defined for a combination of factors comprising the first substrate type and size, the first printer processing speed and a second interpage gap. The first thermal load may occur when substrates are passing through the fuser assembly 30 having the first interpage gap and the second thermal load, which is less than the first thermal load, may occur when substrates are passing through the fuser assembly 30 having the second interpage gap, wherein the first interpage gap is less than the second interpage gap. It is additionally contemplated that a first heater temperature setpoint may be defined for a combination of factors comprising a first substrate type and size, a first printer processing speed, a first interpage gap, and a first cooling fan speed and a second heater temperature setpoint may be defined for a combination of factors comprising the first substrate type and size, the first printer processing speed, the first interpage gap, and a second cooling fan speed. The first thermal load may occur when substrates are passing through the fuser assembly 30 with the cooling fan 65 operating at the first cooling fan speed and the second thermal load, which is less than the first thermal load, may occur when substrates are passing through the fuser assembly 30 with the cooling fan 65 operating at the second cooling fan speed, wherein the first cooling fan speed is greater than the second cooling fan speed.

In the illustrated embodiment, the fuser belt 60 operates under a first thermal load during a print operation, where the print operation may comprise the printing of a single substrate or the continuous printing of two or more substrates of the same type and size, at the same printer processing speed, and same interpage gap. After two or more successive substrates of the same type and size have been printed and fused in a continuous print operation at the same printer processing speed and same interpage gap, the fuser belt 60, operating at the first thermal load, reaches a steady state temperature falling within the range of a corresponding belt temperature $T_B$+/−10 degrees C.

Once the print operation has been completed and presuming the fuser belt 60 stops, i.e., the printer 10 is in an idle mode, the fuser belt 60 is operating under the second thermal load, i.e., the rate at which heat is transferred away from the belt 60 while operating under the second thermal load is much less than the rate at which heat is transferred away from the belt 60 when operating under the first thermal load. If the heater 59 is controlled and held at the first heater temperature setpoint while the fuser belt 60 is operating under the second thermal load, the temperature of the fuser belt 60 will increase beyond the temperature range defined by the belt temperature $T_B$+/−10 degrees C. corresponding to the first heater temperature setpoint. An increase in the temperature of the fuser belt 60 during the idle mode may be disadvantageous as the belt 60 may be at an elevated temperature at the start of a subsequent print operation, causing a temperature overshoot condition, i.e., the elevated fuser belt temperature is above the fuser belt temperature range defined by a corresponding belt temperature $T_B$+/−10 degrees C. for the subsequent print operation. Hence, the elevated fuser belt temperature may result in toner hot offset for the subsequent print operation.

Once the first print operation has been completed and no further print operations are to be effected, the controller 12 determines that the fuser belt 60 is operating under the second thermal load and, consequently, changes the heater temperature setpoint from the first heater temperature setpoint to the second heater temperature setpoint, where the second temperature setpoint is less than the first temperature setpoint.

Figure 3:
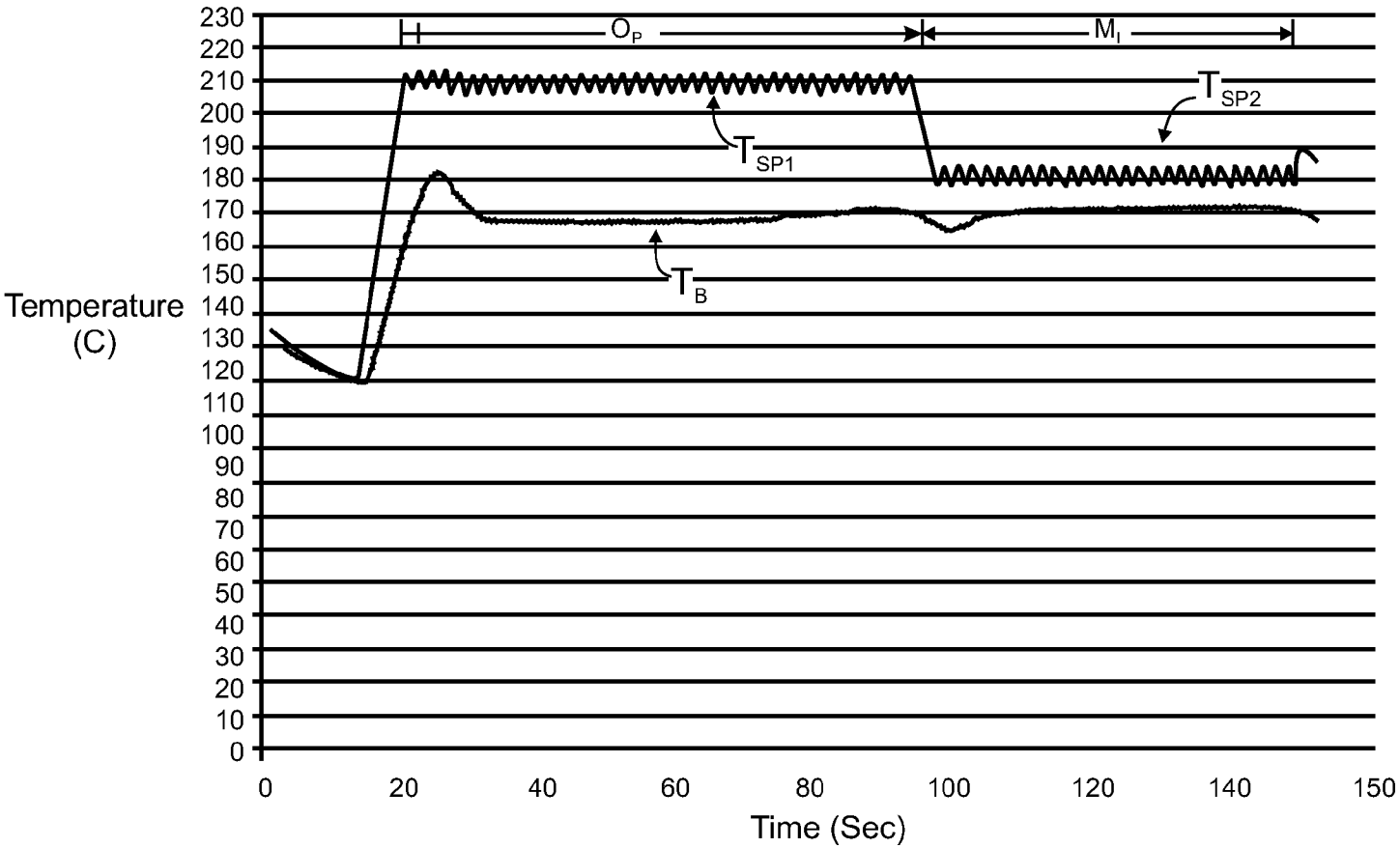
FIG. 3 illustrates plots for a heater and fuser belt of a fuser assembly constructed and operated in accordance the present invention.

In an example print operation $O_P$ illustrated in FIG. 3, the heater 59 was controlled to a first heater temperature setpoint $T_{SP1}$ equal to about 210 degrees C. During the print operation $O_P$ and while the heater 59 was controlled to the first heater temperature setpoint $T_{SP1}$, the fuser belt temperature $T_B$ was equal to about 170 degrees C., which corresponded to the fuser belt temperature $T_B$ for the type and size of the substrates printed, the printer processing speed, and the substrate interpage gap. Once the print operation $O_P$ was completed and since no further print operation were to be effected, the controller 12 caused the printer 10 to operate in an idle mode $M_I$. Accordingly, the controller 12 changed the heater temperature setpoint from the first set point $T_{SP1}$ to a second set point $T_{SP2}$, which was about 182 degrees C. As is apparent from FIG. 3, the belt temperature $T_B$ during the idle mode $M_1$ remained approximately equal to the corresponding fuser belt temperature $T_B$ equal to about 170 degrees.

A temperature undershoot condition, i.e., droop, may occur if the controller 12 starts controlling the heater 59 to the first heater temperature setpoint too late after a substrate enters the nip 53 of the fuser assembly 30. Further, an overshoot condition may occur if the controller 12 starts controlling the heater 59 to the first heater temperature setpoint too early before a substrate enters the nip 53 of the fuser assembly 30. One skilled in the art will be able to program the controller 12 to optimize timing as to when the first temperature setpoint or the second temperature setpoint should be selected by the controller 12 for use in controlling the heater 59.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of controlling a temperature in a fuser assembly of a printing apparatus, comprising:

providing a heat transfer member, a heater to heat said heat transfer member, and a backup member, said heat transfer member and said backup member defining a fusing nip;

defining a first heater temperature setpoint corresponding to a first thermal load for said heat transfer member;

defining a second heater temperature setpoint different from said first temperature setpoint corresponding to a second thermal load for said heat transfer member; and maintaining said heater at or near said first temperature setpoint during at least a substantial portion of the time when said heat transfer member is operating at said first thermal load and maintaining said heater at or near said second temperature setpoint during at least a substantial portion of the time when said heat transfer member is operating at said second thermal load, wherein a temperature of said heat transfer member at said fusing nip during said portion of time when operating at said first thermal load is substantially the same as a temperature of said heat transfer member at said fusing nip during said portion of time when operating at said second thermal load;

wherein said first heater temperature setpoint is based upon substrate size, a processing speed of said printing apparatus and a first interpage gap between substrates during a print operation;

wherein said second heater temperature setpoint is based upon said substrate size, said processing speed of said printing apparatus and a second interpage gap between substrates during said print operation, said second interpage gap being different from the first interpage gap;

wherein said maintaining is performed without measuring temperature.

2. The method of claim 1, wherein said second thermal load occurs when said heat transfer member is stationary relative to said backup member.

3. The method of claim 1, wherein said first thermal load for said heat transfer member occurs when said heat transfer member is moving relative to said backup member.

4. The method of claim 1, wherein said first thermal load for said heat transfer member occurs during a substrate fusing operation where a substrate passes through said fusing nip.

5. The method of claim 1, wherein said first thermal load occurs when a printer fan is operating at a first speed and said second thermal load occurs when said printer fan speed is operating at a second speed, which is less than said first speed.

6. The method of claim 1, wherein said first thermal load occurs when said heat transfer member is operating at a first speed and said second thermal load occurs when said heat transfer member is operating at a second speed, which is less than said first speed.

7. The method of claim 1, wherein said first thermal load occurs when substrates are passing through said fusing nip and have said first interpage gap and said second thermal load occurs when substrates are passing through said fusing nip and have said second interpage gap, which is greater than said first interpage gap.

8. The method of claim 1, wherein said heat transfer member comprises a belt.

9. The method of claim 1, wherein said first temperature setpoint is greater than said second temperature setpoint.

10. The method of claim 1, wherein said maintaining comprises measuring an interpage gap between media sheets during the print operation and selecting said first temperature setpoint at which said heater is maintained if the measured interpage gap corresponds to said first interpage gap and selecting said second temperature setpoint if the measured interpage gap corresponds to said second interpage gap.

11. The method of claim 10, wherein said maintaining is performed without changing the measured interpage gap during the print operation.

12. A fuser assembly comprising:

a heat transfer member;

a heater to heat said heat transfer member;

a backup member adapted to engage said heat transfer member so as to define a fusing nip with said heat transfer member; and a controller coupled to said heater to maintain said heater at or near a first temperature setpoint during at least a substantial portion of the time when said heat transfer member is operating at a first thermal load and to maintain said heater at or near second temperature setpoint different from said first temperature setpoint during at least a substantial portion of the time when said heat transfer member is operating at a second thermal load, wherein a temperature of said heat transfer member at said fusing nip during said portion of time when operating at said first thermal load is substantially the same as a temperature of said heat transfer member at said fusing nip during said portion of time when operating at said second thermal load;

wherein said first heater temperature setpoint is based upon substrate size, a processing speed of said printing apparatus and a first interpage gap between substrates during a print operation;

wherein said second heater temperature setpoint is based upon said substrate size, said processing speed of said printing apparatus and a second interpage gap between substrates during said print operation different from said first interpage gap;

wherein during the print operation said controller measures an interpage gap between sheets associated with the print operation and selects said first temperature setpoint at which said heater is maintained if the measured interpage gap corresponds to said first interpage gap and selects said second temperature setpoint if the measured interpage gap corresponds to said second interpage gap, without altering the interpage gap during the print operation.

13. The fuser assembly of claim 12, wherein said second thermal load occurs when said heat transfer member is stationary relative to said backup member.

14. The fuser assembly of claim 12, wherein said first thermal load for said heat transfer member occurs when said heat transfer member is moving relative to said backup member.

15. The fuser assembly claim 12, wherein said first thermal load for said heat transfer member occurs during a substrate fusing operation where a substrate passes through said fusing nip.

16. The fuser assembly of claim 12, wherein said first thermal load occurs when a printer fan is operating at a first speed and said second thermal load occurs when said printer fan speed is operating at a second speed, which is less than said first speed.

17. The fuser assembly of claim 12, wherein said first thermal load occurs when said heat transfer member is operating at a first speed and said second thermal load occurs when said heat transfer member is operating at a second speed, which is less than said first speed.

18. The fuser assembly of claim 12, wherein said first thermal load occurs when substrates are passing through said fusing nip and have said first interpage gap between them and said second thermal load occurs when substrates are passing through said fusing nip and have said second interpage gap between them, which is greater than said first interpage gap.

19. The fuser assembly of claim 12, wherein said heat transfer member comprises a belt.

20. The fuser assembly of claim 12, wherein said second temperature setpoint is less than said first temperature setpoint.

21. The fuser assembly of claim 12, wherein the controller selects said temperature setpoint at which said heater is maintained and maintains said heater at said selected temperature setpoint without measuring temperature or receiving a temperature measurement.

22. A method of controlling a temperature in a fuser assembly of a printing apparatus, comprising:

providing a heat transfer member, a heater to heat said heat transfer member, and a backup member, said heat transfer member and said backup member defining a fusing nip;

defining a first heater temperature setpoint corresponding to a first thermal load for said heat transfer member;

defining a second heater temperature setpoint different from said first temperature setpoint corresponding to a second thermal load for said heat transfer member; and maintaining said heater at or near said first temperature setpoint during at least a substantial portion of the time when said heat transfer member is operating at said first thermal load and maintaining said heater at or near said second temperature setpoint during at least a substantial portion of the time when said heat transfer member is operating at said second thermal load, wherein a temperature of said heat transfer member at said fusing nip during said portion of time when operating at said first thermal load is substantially the same as a temperature of said heat transfer member at said fusing nip during said portion of time when operating at said second thermal load;

wherein said first heater temperature setpoint is based upon a first interpage gap between substrates during a print operation;

wherein said second heater temperature setpoint is based upon a second interpage gap between substrates during said print operation, said second interpage gap being different from the first interpage gap;

wherein said maintaining comprises measuring an interpage gap between media sheets during the print operation and selecting said first temperature setpoint at which said heater is maintained if the measured interpage gap corresponds to said first interpage gap and selecting said second temperature setpoint if the measured interpage gap corresponds to said second interpage gap.

23. The method of claim 22, wherein said first heater temperature setpoint is further based upon substrate size and a processing speed of said printing, and said second heater temperature setpoint is further based upon said substrate size and said processing speed of said printing apparatus.

24. The method of claim 22, wherein said maintaining is performed without measuring temperature.

* * * * *